US011628110B2

(12) United States Patent
Zwettler et al.

(10) Patent No.: US 11,628,110 B2
(45) Date of Patent: Apr. 18, 2023

(54) SUPPORT APPARATUS AND METHOD WITH SHEAR RELIEF

(71) Applicant: THINAIR SURFACES LLC, Stillwater, MN (US)

(72) Inventors: Chris James Zwettler, Stillwater, MN (US); Rich Baumhardt, Breckenridge, MN (US); Jason Hanzlik, Wahpeton, ND (US); Jim Albrecht, Wahpeton, ND (US)

(73) Assignee: THINAIR SURFACES LLC, Stillwater, MN (US)

( * ) Notice: Subject to any disclaimer, the term of this patent is extended or adjusted under 35 U.S.C. 154(b) by 114 days.

(21) Appl. No.: 16/882,877

(22) Filed: May 26, 2020

(65) Prior Publication Data

US 2020/0281786 A1 Sep. 10, 2020

Related U.S. Application Data

(63) Continuation of application No. PCT/US2018/015095, filed on Jan. 24, 2018, and a continuation-in-part of application No. 15/157,119, filed on May 17, 2016, now Pat. No. 10,660,810.

(60) Provisional application No. 62/162,767, filed on May 17, 2015.

(51) Int. Cl.

| | |
|---|---|
| ***A61G 7/057*** | (2006.01) |
| ***A47C 27/08*** | (2006.01) |
| ***A47C 27/10*** | (2006.01) |

(52) U.S. Cl.

CPC ..... *A61G 7/05776* (2013.01); *A47C 27/082* (2013.01); *A47C 27/10* (2013.01)

(58) Field of Classification Search

CPC ..... A47C 27/10; A47C 27/08; A47C 27/081; A47C 27/082; A47C 27/083; A61G 7/05776

See application file for complete search history.

(56) References Cited

U.S. PATENT DOCUMENTS 2,998,817 A * 9/1961 Armstrong ..... A61F 7/10 601/149
4,914,771 A * 4/1990 Afeyan ..... A61G 7/05792 5/713
5,657,499 A * 8/1997 Vaughn ..... B60N 2/914 297/284.6
6,134,732 A * 10/2000 Chapman ..... A61G 7/05776 5/713

(Continued)

*Primary Examiner* — David R Hare
*Assistant Examiner* — George Sun
(74) *Attorney, Agent, or Firm* — Crawford Maunu PLLC

(57) ABSTRACT

Various aspects of the present disclosure are directed to an apparatus and/or method involving respective sets of interleaved pressure cells, which operate to inflate and deflate independently of one another. The pressure cells further provide shear relief by deflecting along a direction of movement, such as along a shear direction of an upper surface coupled to the pressure cells. Such deflection may, for example, be implemented with elongated pressure cells and along a direction that is perpendicular to a length thereof. Shear relief in this regard may be facilitated by undercut regions of the respective pressure cells, at which location the pressure cells are coupled to an underlying surface and which is smaller in dimension relative to an overlying portion of the pressure cell.

20 Claims, 11 Drawing Sheets

(56) References Cited

U.S. PATENT DOCUMENTS

| | | | | |
|---|---|---|---|---|
| 6,370,716 | B1 * | 4/2002 | Wilkinson | A61G 7/05776 297/452.41 |
| 2002/0050010 | A1 * | 5/2002 | Shimada | A61G 7/05776 5/706 |
| 2003/0208848 | A1 * | 11/2003 | Flick | A61G 7/05769 5/713 |
| 2004/0128772 | A1 * | 7/2004 | Branson | A61G 7/05776 5/713 |
| 2006/0010607 | A1 * | 1/2006 | Schneider | F16K 31/002 5/713 |
| 2007/0143928 | A1 * | 6/2007 | Biggie | A61G 7/05776 5/713 |
| 2010/0205750 | A1 * | 8/2010 | McCausland | A61G 7/05776 5/713 |
| 2011/0047703 | A1 * | 3/2011 | Tarsaud | A61G 7/001 5/607 |
| 2014/0210250 | A1 * | 7/2014 | DiFelice | B60N 2/64 297/452.48 |
| 2017/0056264 | A1 * | 3/2017 | Chapin | A47C 27/082 |

* cited by examiner

SUPPORT APPARATUS AND METHOD WITH SHEAR RELIEF

OVERVIEW

Aspects of various embodiments are directed to apparatuses and methods for providing support, with shear relief.

Pressurized support structures are useful for a variety of purposes. Such structures may be used to support the weight of a person. However, for certain applications involving relatively long periods of immobility or low mobility, such pressure applied can pose challenges. For instance, patients lying on a hospital bed may develop ulcers. Further, pressurized support structures can cause discomfort, relative to movement and otherwise.

These and other matters have presented challenges to the manufacture and implementation of such devices, for a variety of applications.

SUMMARY

Various example embodiments are directed to some or all components of an apparatus and its implementation, involving the application of pressure for treatment, therapy and/or support. Such aspects may address one or more issues such as those addressed above and/or others which may become apparent. Various embodiments thus address challenges to the treatment of patients under conditions in which the patients are immobile or move very little for a period of time. Furthermore, various embodiments are directed to integrated solutions involving the application of pressure, such as may be integrated into support structures involving hospital beds, operating tables, and others.

In accordance with various embodiments, an apparatus includes first and second sets of pressure cells in which cells in the first set are interleaved with cells in the second set. Each set of pressure cells is operable to inflate and deflate independently of the other set. In some instances, the pressure cells are elongated and have a length and width, and provide shear relief by deflecting in a direction that is perpendicular to the length of the elongated pressure cells.

Another embodiment is directed to a method as follows. A membrane is formed with recesses for first and second set of pressure cells, with alternating ones of the pressure cells being interleaved. A first pressure inlet channel is coupled to the first set of pressure cells, and a second pressure inlet channel is coupled to the second set of pressure cells. The pressure are cells sealed by coupling the membrane to an underlying sheet, therein configuring each set of the pressure cells to: inflate and deflate independently of the other of the first and second sets, and while inflated, provide shear relief, such as by deflecting in a direction that is perpendicular to a length of the pressure cells.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description in connection with the accompanying drawings, in which.

Figure 1:
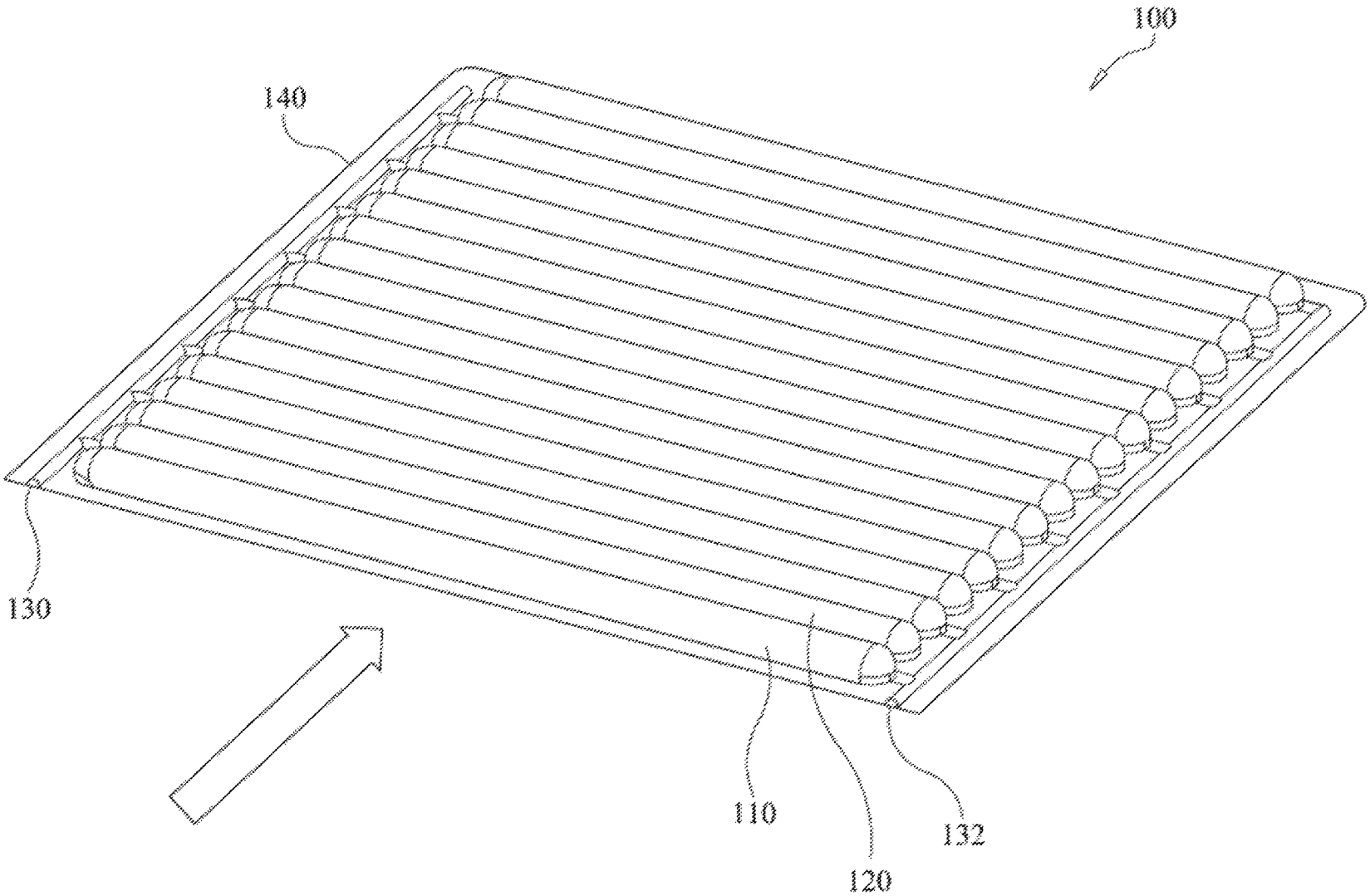
FIG. 1 shows an isometric view of an apparatus in accordance with the present disclosure.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving the application of pressure with relief in a shear direction. Various embodiments are amenable to implementation for the support of the human body, such as between a support (e.g., part of a bed or chair/seat) and a person's skin or clothing. Certain embodiments are directed to ulcer prevention in a medical setting, as may be applicable to a gurney or bed, such as in a surgical setting. Other embodiments are directed to application with instances where a patient or individual is immobile for long periods of time, such as those in which the patient or individual is at risk of developing decubitus ulcers or otherwise subjected to discomfort. These and other embodiments may be implemented with a pressurized support structure that operates by applying support that alternates between different components within the structure, such as by inflating and deflating adjacent pressure cells. The pressurized support structure also provides for movement/flexibility along one or more shear directions.

In various embodiments, movement/flexibility in a shear direction is provided to allow movement of an individual along a shear direction while mitigating discomfort that may otherwise arise from surfaces that are not flexible in such a shear direction. In connection with such embodiments, it has been discovered that relative of adjacent pressure cells facilitates movement of the pressure cells along a shear direction. This movement can provide relief of shear pressure that may otherwise exist in support structures, such as by providing elongated cells (e.g., having a cell length that is ten or more times cell width) normal to expected movement of a body lying on the cells. Such elongated pressure cells can "roll" relative to the length dimension of the patient, which can mitigate shearing effects upon a patient's skin, which can mitigate contact pressure for reducing/minimizing stresses that cause decubitus ulcers. Other spherical type cells may also facilitate shear relief in this regard, by deflection. Accordingly, while various embodiments are characterized herein involving elongated pressure cells, spherical type or other type cells that facilitate shear relief may be utilized in addition to, or in replacement of, such elongated pressure cells.

It has further been discovered that such an anti-shear effect can be achieved while preventing "bottoming out" of a patent lying on the cells with some of the cells being deflated, by placing the cells in relative proximity. Such support can be provided for a target weight (e.g., for a weight range of a human body lying on the cells), such that a sufficient number of cells in sufficient proximity are in an inflated (and supporting) state, where the terms "sufficient" are such that the target weight is supported and being insufficient in this regard would allow bottoming out. In Further, by providing multiple small cells that interact with bony prominences of patients, movement is facilitated along with inflation/deflation of individual cells while preventing such prominences from bottoming out (e.g., through the cells to an underlying structure).

Controlling the inflation and deflation of respective pressure cells can be tailored to particular applications. For example, a first set of pressure cells that are deflated may be cycled to inflate while a second set of interleaved pressure cells remain inflated until the first set of pressure cells are partially or fully inflated, after which the second set of interleaved pressure cells are deflated. In some embodiments, a high level of support is provided during an initial period, such as when a patient is lifted onto a bed or climbs onto the bed, by inflating most or all pressure cells. After the patient has settled onto the bed and is in a relaxed position, fluid in respective sets of the cells is alternatingly with evacuated and filled to create alternating pressure support as noted herein.

Various embodiments are amenable to integration of pressure componentry with respective applications. Some such embodiments involve, for example, implementation with beds or tables such as those used in hospital settings. In particular, where a user/patient is to be stationary for a period of time such as while sedated or sleeping, pressure cells and related controls as characterized herein can be integrated with support structure such as padding or bedding. For instance, certain embodiments are directed to applications involving altering pressure within a pad that is integrated with an operating table.

One or more embodiments involve utilizing pressure fluctuation with shear-type relief, for supporting a user (e.g., patient) on a surface underlying the user while depressurizing respective regions of the surface underlying the user. Adjacent pressure regions within the surface are pressurized and depressurized, with shear relief/movement provided in a lateral direction along the surface to facilitate sufficient depressurization of the pressure regions. For instance, where a depressurized region is located between two pressurized regions, what may be referred to as a "hammock effect" may cause the depressurized region to continue to apply relatively high pressure onto an overlying user. Lateral shear relief is utilized to mitigate such a "hammock effect" and facilitate adequate depressurization. This approach can be utilized to depressurize regions of the underlying surface below human capillary pressure threshold, relative to blood perfusion pressure limit (e.g., below 32 inHg), and therein mitigate issues such as pressure ulcers. Shear relief in this regard may be provided in a variety of manners, such as those characterized in connection with FIGS. 3 and 4.

Figure 3:
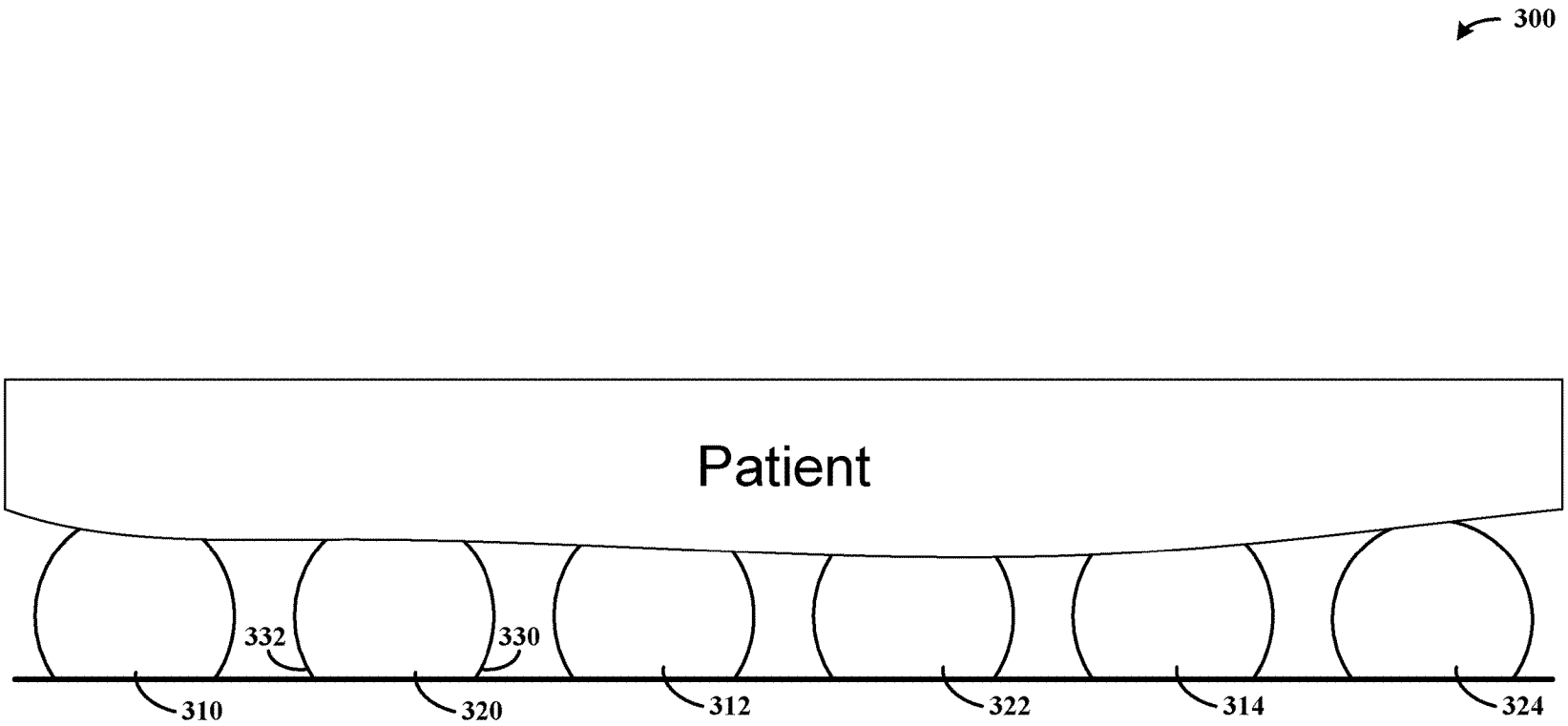
FIG. 3 shows pressure cells with an undercut, in accordance with the present disclosure.
Figure 4:
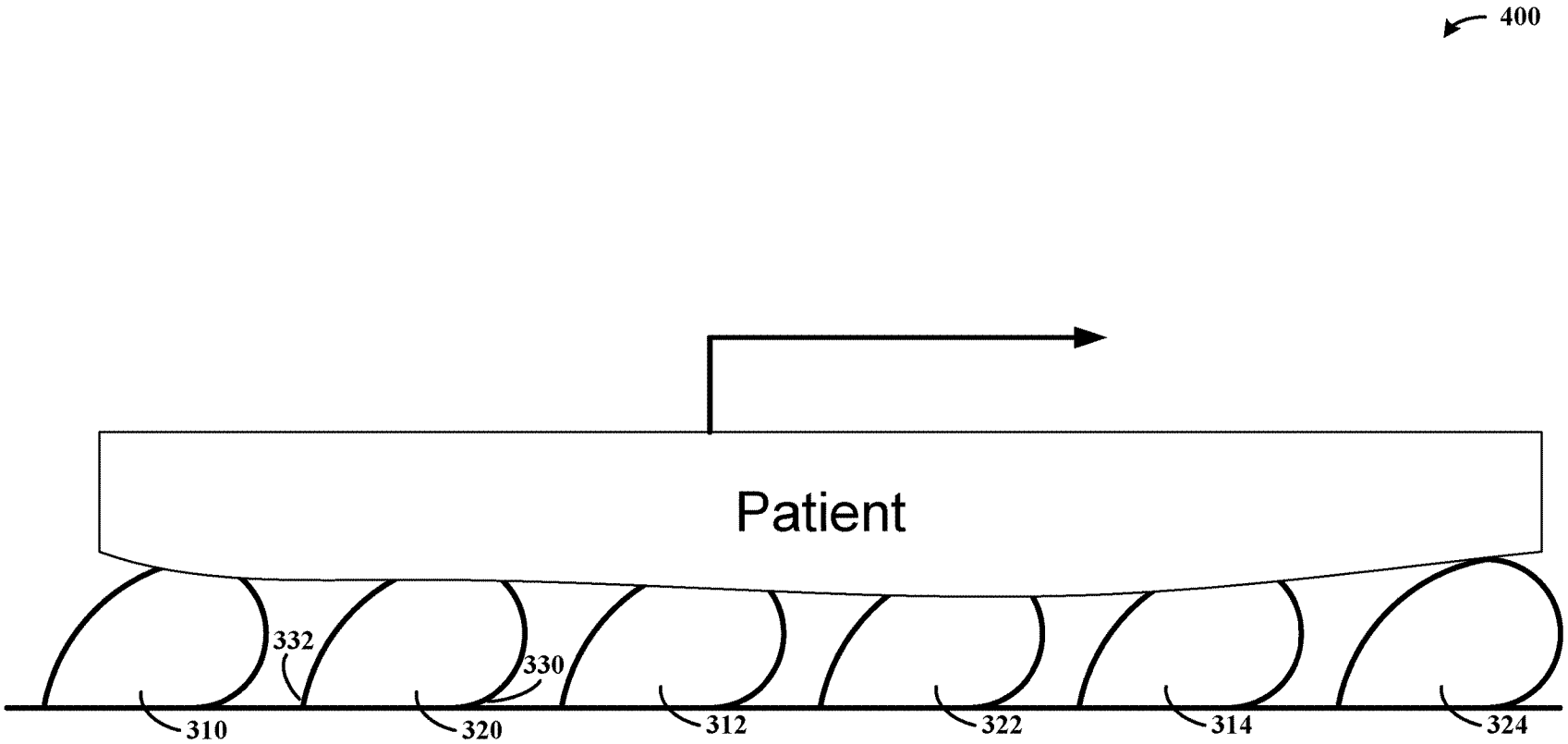
FIG. 4 shows pressure cells with an undercut and with applied shear, in accordance with the present disclosure.
Figure 10:
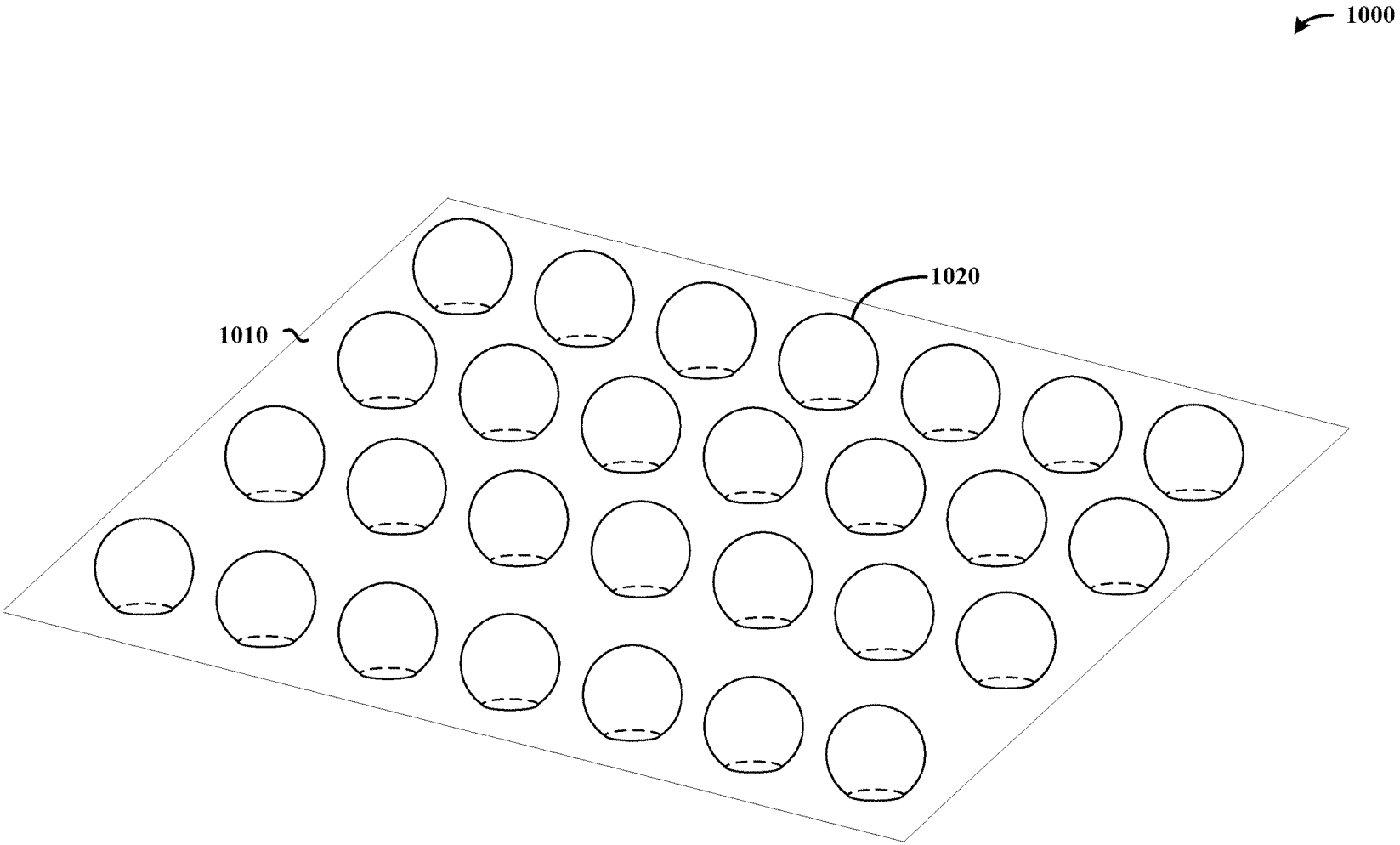
FIG. 10 shows a pressure cell structure, in accordance with the present disclosure.

Accordingly, various manners may be utilized to reduce lateral tension along the surface, as may be implemented with different types of pressure cells such as elongated cells similar to that shown in FIG. 1, or individual cells (e.g., small spheres or ovals) such as shown in FIG. 10. Shear relief may be provided, for example, with such elongated or individual cells as shown in FIGS. 3 and 4, with undercut regions therein.

Adjacent pressure cells can be spaced to suit particular applications, and such spacing may vary to accommodate different support needs. For instance, a human heel may have different support needs than a human back. For supporting smaller regions such as a human heel, high point pressure can be increased to mitigate bottoming out where only a few cells span the heel, or cell spacing and/or size can be adjusted to accommodate the region size (and related point pressure). As such, the spacing shown in the figures (e.g., FIGS. 1 and 10) can be tailored to different regions of the pad in which the pressure cells are utilized. In this context, a design tradeoff may be struck with regard to providing adequate support and relieving shear for mitigating the "hammock effect" as discussed herein. Further, point contact regions such as the heel or head area may not exhibit as much of a need for shear relief as other regions of the torso may, facilitating the trade-off.

In accordance with various embodiments, an apparatus includes first and second sets of pressure cells in which cells in the first set are interleaved with cells in the second set. Each set of pressure cells is operable to inflate and deflate independently of the other set. The pressure cells have a length and width and provide shear relief by deflecting in a direction that is perpendicular to the length of the pressure cells. This approach can be used to prevent flattening of the pressure cells onto the underlying surface under a patient's weight and/or prevent a portion of the patient's body from exerting direct pressure (e.g., via a collapsed pressure cell) onto an underlying surface via an empty/evacuated pressure cell.

In various contexts, an elongated pressure cell is a pressure cell having a length greater than its width, such that it is operable to provide shear relief in a direction along the width. This may, for example, involve a pressure cell having a length that is five, ten or more times its width. These aspects may further involve an undercut region that facilitates roll as characterized herein.

In various embodiments involving elongated pressure cells, each elongated pressure cell includes respective undercut regions extending along a length of the elongated pressure cell at intersections between the pressure cell and an underlying surface. For instance, where formed as part of an upper sheet that is laminated onto another sheet, the undercut may be provided at the intersection between a flat portion of that sheet and a protrusion that forms the pressure cell. The width of the elongated pressure cell at the intersection is less than a width of a cross-section of the pressure cell that is elevated above the intersection (e.g., with the pressure cell inflated), which can provide movement of the cell in response to shear pressure/movement of a patient or object in contact with an upper portion of the pressure cells. The width of such an elevated cross-section can be set sufficiently larger than the width of the elongated pressure cell at the intersection to facilitate the deflection of an upper portion of the elongated pressure cell in a direction along the width thereof, thereby providing the shear relief. In this context, a sufficiently larger width is one that permits a desired amount of deflection along the direction of the width. In some instances, the width/undercut can be set to provide movement of about 10 mm of an upper surface of the cells while imparting little or no shear force onto an object resting on the upper surface. This deflection may be exhibited, for example, when the elongated pressure cells are inflated and in contact with a patient supported thereby.

Various embodiments also include fluid delivery componentry that selectively inflates and deflates the first and second sets of elongated pressure cells. This componentry may include valving and a pump that operates to effect the inflation and deflation of the elongated pressure cells independently from one another for respective periods of time. The valving and pump may thus be implemented to inflate the first set of elongated pressure cells during a first period of time while the second set of elongated pressure cells is deflated or in a partially inflated state, and similarly inflate the second set of elongated pressure cells during a second period of time while the first set of elongated pressure cells is deflated. Evacuation and filling of the pressure cells may be carried out using fluid that is cycled between the two sets of pressure cells and/or shared in a common reservoir. For instance, a reversible pump may be used with the sets of elongated pressure cells to evacuate fluid from one of the sets of elongated pressure cells and to utilize the evacuated fluid to inflate the other one of the sets of elongated pressure cells.

Other embodiments include third and fourth sets of elongated pressure cells, with each elongated pressure cell in the third set being interleaved with elongated pressure cells of the fourth set. The elongated pressure cells in the third and fourth sets may extend in a direction that is different than the direction of the length of the elongated pressure cells in the first and second sets of elongated pressure cells.

One or more of the above embodiments may further include a pad having the respective pressure cells therein and an upper surface thereof, wherein the pad is configured and arranged with the first and second sets of pressure cells to mitigate the generation of shear forces on the upper surface via the deflection.

In some embodiments, the first and second set of pressure cells form a closed system in which fluid exhausted from one of the set of pressure cells is utilized to inflate the other one of the set of pressure cells. A controller, having circuitry, is configured and arranged to control alternating inflation and deflation of the first and second sets of pressure cells. The controller includes a relief valve configured and arranged to facilitate intake of fluid into the apparatus for inflating the respective sets of pressure cells, in response to detecting loss of fluid from the closed system.

Another embodiment is directed to a method as follows. A membrane is formed with recesses for first and second set of elongated pressure cells, with alternating ones of the elongated pressure cells being interleaved. A first pressure inlet channel is coupled to the first set of elongated pressure cells, and a second pressure inlet channel is coupled to the second set of elongated pressure cells. The elongated pressure are cells sealed (e.g., laminated) by coupling the membrane to an underlying sheet, therein configuring each set of the elongated pressure cells to: inflate and deflate independently of the other of the first and second sets, and while inflated, provide shear relief by deflecting in a direction that is perpendicular to the length of the elongated pressure cells. The size of the recesses can be set such that, when coupled to the underlying sheet, sufficient support is provided for a patient having a target weight and to prevent flattening of the pressure cells onto an underlying surface while supporting the patient.

In some implementations, each elongated pressure cell is formed with respective undercut regions extending along a length of the pressure cell at intersections between the pressure cell and an underlying surface. The width of the elongated pressure cell at the intersection is set to be less than a width of a cross-section of the elongated pressure cell that is elevated above the intersection. The elevated cross-section may, for example, have a width that is sufficiently larger than the width of the elongated pressure cell at the intersection to facilitate deflection of an upper portion of the elongated pressure cell in a direction along the width thereof (and thereby providing the shear relief).

Turning now to the Figures, FIG. 1 shows an isometric view of an apparatus 100 in accordance with the present disclosure. The apparatus 100 includes a plurality of adjacent pressure cells, including cells 110 and 120 labeled by way of example. Fluid inlet channels 130 and 132 are respectively coupled to alternating ones of the pressure cells, and operable for inflation and deflation thereof. In some instances, a fluid such as air is filled in pressure cell 120 and every other alternating cell therefrom via fluid inlet channel 130, while pressure cell 110 and every other alternating cell therefrom are partially or fully deflated. Such a fluid can then be evacuated from the filled pressure cells (including pressure cell 120), with fluid (the same or other fluid) being filled to inflate pressure cell 110 and those alternating therefrom. The inflation/deflation may be implemented such that support is provided at all times by one or both of the sets of alternating pressure cells.

In various embodiments, the alternating pressure cells are configured and arranged to deflect under shear in a direction as indicated by the arrow in FIG. 1. For instance, where pressure cell 110 and those alternating therefrom (and coupled to fluid inlet channel 132) are inflated, those inflated pressure cells provide some roll, or movement, in the direction of the arrow so as to mitigate the development of shear forces. Such an approach can achieve benefits, including those as noted above.

A variety sizes and arrangements of pressure cells are implemented to address certain shear applications. For instance, while FIG. 1 shows a rectangular sheet, sheets of various shapes and sizes are used to suit particular applications. In addition, where shear stresses are anticipated as occurring in different directions at different points of contact (e.g., along a patient's body), the arrangement of elongated pressure cells can be tailored to suit mitigation of such stress.

The construction of the apparatus 100 may also be tailored to suit particular embodiments, such as to incorporate available materials or manufacturing approaches. In some embodiments, the apparatus 100 is a two-part laminate structure with a relatively flat lower layer to which an upper layer is adhered (e.g., along edges of the apparatus at. The upper layer has recesses that form the pressure cells and fluid inlet channels as shown.

Figure 2:
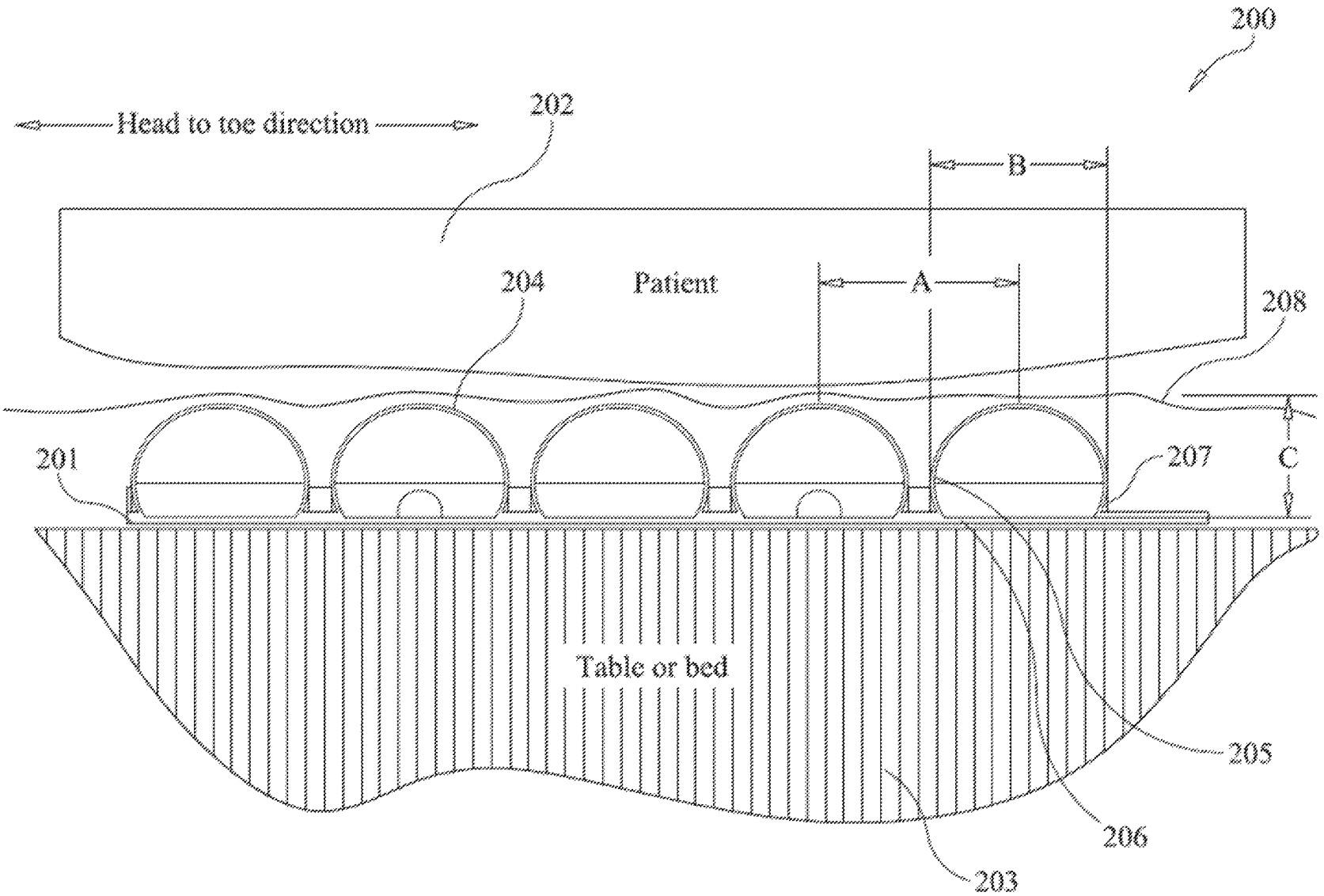
FIG. 2 shows a section view of an apparatus, in accordance with the present disclosure.

FIG. 2 shows a section view of an apparatus 200, in accordance with the present disclosure. The apparatus 200 includes a support pad 201 operable to support a patient (202), and is shown by way of example positioned between the patient and support 203 (e.g., a table or bed) that the patient is resting on. The support pad 201 includes of long, thin, parallel, tubular cells 4 with length dimension aligned in a transverse direction to the height (head to toe) dimension of the patient. Five pressure cells are shown by way of example, including pressure cell 204, with alternating ones of the pressure cells being coupled to a common pressure inlet for alternate inflation/deflation. This alternate inflation/deflation can be carried out to relieve local contact pressure against the patient.

Each pressure cell is connected to an underlying surface at undercut regions 207, with a cross-section at the underlying surface being less than that at an elevated portion of the pressure cell (e.g., cross-section "B"). This undercut facilitates movement of an upper surface of each cell along with movement of the patient along the indicated head-to-toe direction, which runs in a direction along the width of each cell. This movement or "roll" effect helps to mitigate or prevent shear tension on the patient 202 as the patient moves relative to the table or bed (and the upper surface of the pressure cells moves with the patient with low/minimal stress). It has been discovered that this approach, together with other aspects noted herein relating to the alternation of pressure application (e.g., and related capillary blood flow enhancement) can address issues as noted herein, such as those relating to ulcers or other conditions that may develop with patients. The undercut can thus serve to relieve shear stress as the bony prominence moves in a direction tangential to the support 203, such as when a patient is positioned or repositioned, or when the support is moved (e.g., as with an adjustable bed).

In various embodiments, the size, height and spacing of the cells are set with inflation pressure therein such that a bony prominence of a patient having a target weight will not "bottom out" against the support 203, in the location of one of the deflated cells or otherwise. Accordingly, these parameters can be set relative to one another and an expected weight to be supported, relative to comfort. Further, different regions of the support pad 201 may be implemented with differently-sized pressure cells, based on expected load. For instance, a load supporting a patient's torso may be higher than a load supporting a patient's arm or leg, and regions of the support pad 201 can be tailored accordingly.

By way of example, some implementations involve cell spacing/pitch "A" of about 0.563 inches, a cell diameter "B" of about 0.5 inches (at a maximum cross-section as shown) and a cell height "C" of about 0.336 inches. A nominal inflation pressure at such sizing may be 4 psig and a nominal deflation pressure may be set equal to or less than a capillary pressure threshold for blood re-profusion, which facilitates blood flow in the patient.

In some implementations, the apparatus 200 is formed by laminating an upper membrane layer 205 with recesses for forming the pressure cells, to a lower layer 206 that seals the bottom of each pressure cell. Other embodiments involve coupling individual pressure cells to an underlying sheet. Still other embodiments involve utilizing a single material for the apparatus 200, with air injection, extrusion, molding, or other approaches.

In some embodiments, a cover or protective layer 208 is utilized to provide a positive "microclimate" (temperature and humidity) for the patient's skin. The cover 208 can be directionally compliant in the "rolling" direction of the support pad, such as along the head-to-toe direction as indicated. This may complement the shear relief aspects as noted above and achieved via the movement/roll of the respective pressure cells. The cover 208 is coupled to provide compliance in the rolling direction of the pressure cells, to mitigate the application of pressure over a deflated cell that may hinder blood flow (e.g., such that resulting contact pressure of the cover 208 against a patient's skin at locations above deflated pressure cells is below the capillary pressure threshold).

In various implementations, the support pad 201 may be implemented in accordance with the structure in apparatus 100 shown in FIG. 1. The respective pressure cells including cell 204 are implemented with the alternating structure shown in FIG. 1, in respective sets of the interleaved cells supplied by the inlet channels 130 and 132.

FIG. 3 shows an apparatus 300 having pressure cells with an undercut, and FIG. 4 shows a similar apparatus 400 having pressure cells with an undercut and with applied shear, in accordance with the present disclosure. By way of example, similar reference numerals are used in each figure with the understanding that the indicated embodiments may be separated. Referring to FIG. 3, a first set of pressure cells includes cells 310, 312 and 314, interleaved with a second set of pressure cells 320, 322 and 324. Each cell has an undercut region at which it is attached to an underlying surface, as shown at 330 and 332. The cells as shown may be implemented with elongated cells, such as shown in FIG. 1, or with spherical-type cells, such as shown in FIG. 10, or with other shapes (e.g., oblong or oval). In some embodiments, the underlying surface forms part of the pressure cells and may further be used to deliver fluid. In other embodiments, fluid is delivered to (and withdrawn from) each pressure cell via an additional fluid conduit.

While the cells in FIG. 3 are shown in a neutral-type state with about no shear, the cells in FIG. 4 are shown with shear applied thereto. For instance, as the patient moves in the direction as shown by the arrow, each pressure cell rolls in the direction of the arrow, utilizing the undercut regions to provide this roll while mitigating the application of shear force on the patient. For instance, as shown at undercut region 332, the undercut allows the upper portion of pressure cell 320 to move in the direction of the arrow, taking up the undercut while the portion of the pressure cell at undercut region 330 "rolls" against the underlying surface. Movement in an opposite direction may be similarly facilitated.

The undercut shown in FIGS. 3 and 4 can be set in size, to facilitate a desired amount of shear. In some implementations, the undercut and size of pressure cells are set to facilitate movement of the patient in the direction shown of about 10 mm while providing minimal to no shear force at an interface between the patient and the pressure cells.

Figure 5:
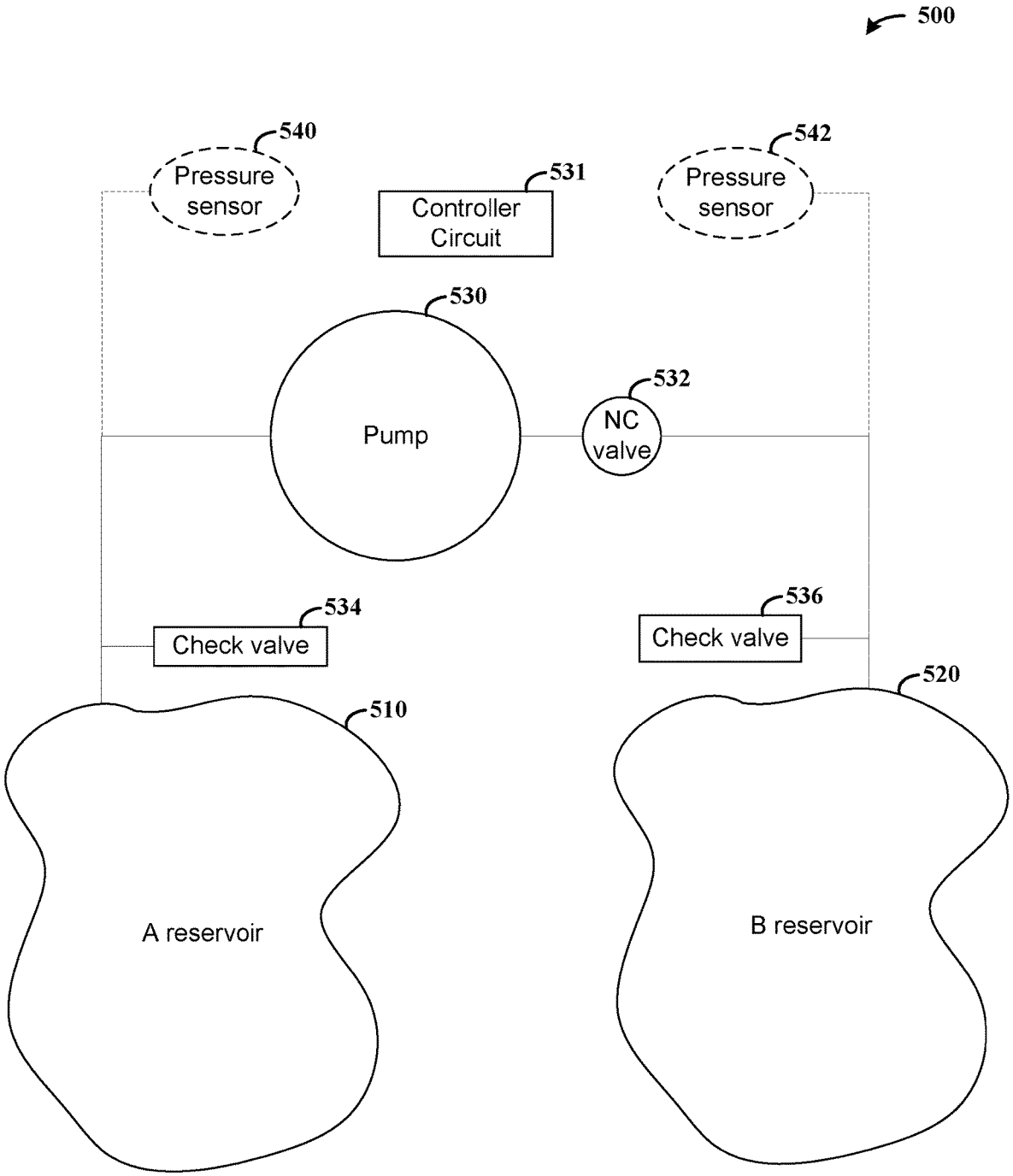
FIG. 5 shows a control apparatus in accordance with the present disclosure.

A variety of fluid delivery approaches may be implemented to suit particular embodiments. FIG. 5 shows a control apparatus 500 for such an approach, in accordance with the present disclosure. The apparatus 500 includes a pump 530 (e.g., a reversible pump) that operates to respectively inflate and deflate reservoirs 510 and 520, as implemented to provide alternating support in accordance with one or more embodiments herein. As such, the apparatus 500 may be coupled to operate the apparatus 100 shown in FIG. 1, with the respective reservoirs feeding each set of elongated pressure cells (or representing the cells themselves).

Additional componentry may be implemented with certain embodiments, including normally closed valve 532 (e.g., with a reversible pump), check valves 534 and 536, pressure sensors 540 and 542, and a controller circuit 531. Such a controller circuit 531 may, for example, include a logic circuit that operates the pump 530 and one or more valves to alternately inflate and deflate each reservoir 510 and 520.

Figure 6:
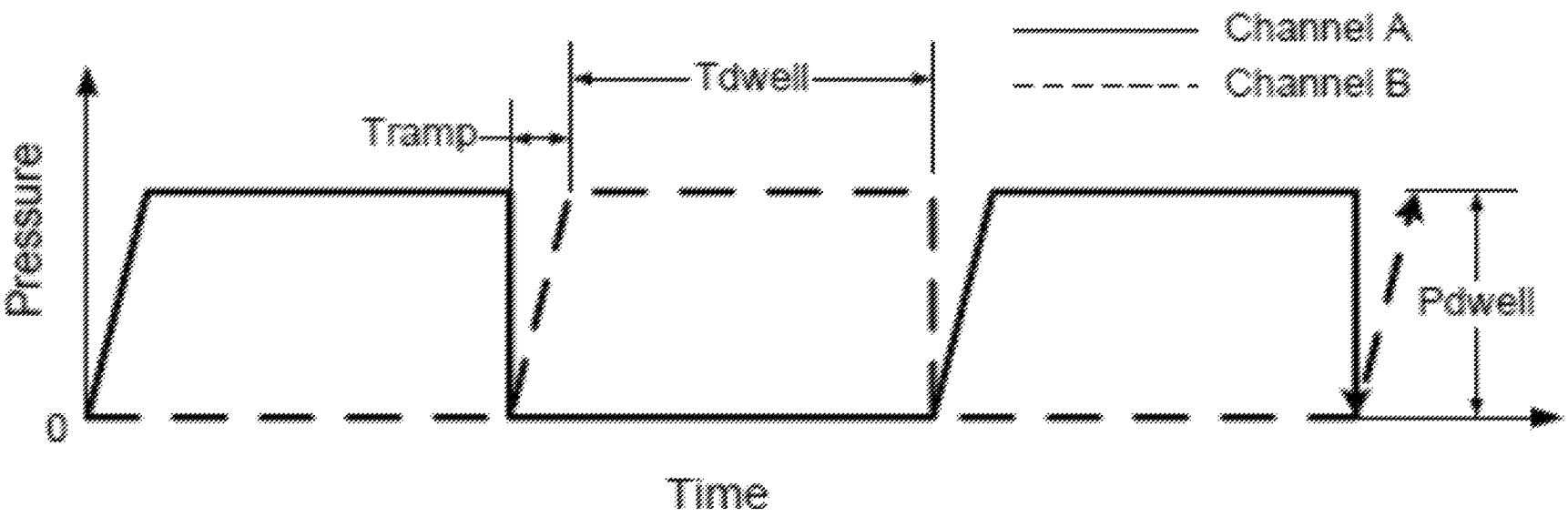
FIG. 6 shows a plot for pressure control, in accordance with the present disclosure.

FIG. 6 shows a plot for pressure control, in accordance with the present disclosure. Pressure is shown in the vertical scale, with time on the horizontal scale. Two channels are shown, channel "A" and channel "B," with each channel operable to provide inflation/deflation for a respective set of pressure cells. For instance, referring to FIG. 1 channel "A" may be used to supply fluid inlet channel 130, and channel "B" may be used to supply fluid inlet channel 132. During a first cycle, channel "A" is active to apply pressure therein. At the end of the first cycle, pressure applied in channel "A" drops and channel "B" is activated to apply pressure therein. By way of example, pressure ($P_{dwell}$) and time ($T_{dwell}$) dwells are shown, along with a ramp $T_{ramp}$ for pressurizing a set of pressure channels. Consistent with discussion herein, the respective channel activation plots may be shifted to ensure that enough pressure remains in one or a combination of adjacent pressure cells to prevent a patient from bottoming out during the transition. This approach may, for example, be implemented by the controller circuit 531 in FIG. 1.

Figure 7:
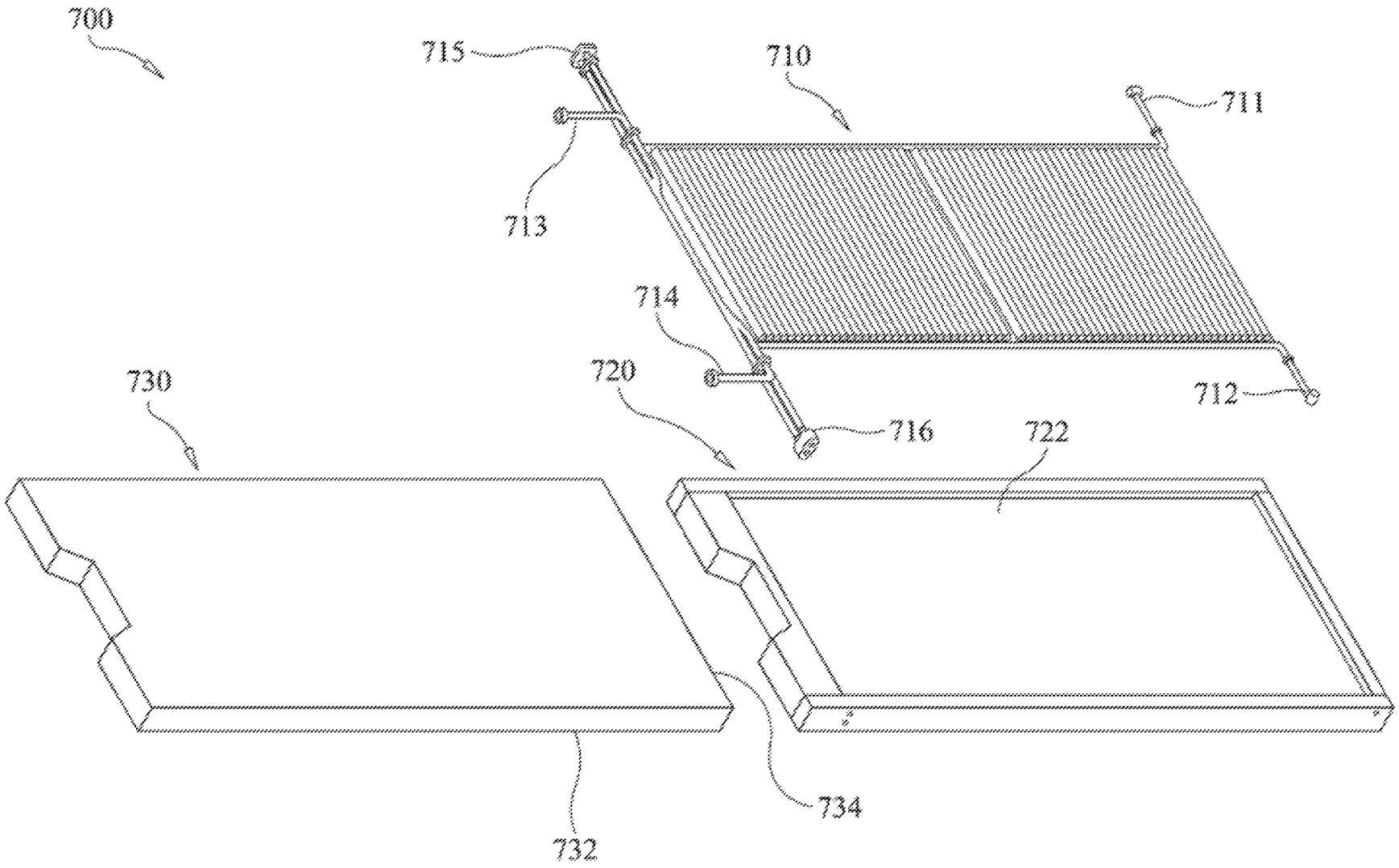
FIG. 7 shows a support pad assembly, in accordance with the present disclosure.

FIG. 7 shows a support pad assembly 700, in accordance with the present disclosure. A pressure cell structure 710 is formed with respective pressure cells exhibiting shear relief, such as shown in FIG. 1 or 10. A variety of fluid connections can be made for passing fluid into and out of the pressure cell structure 710, such as for connecting to other pads or to a pressure supply/exhaust. By way of example, connections 711, 712, 713 and 714 are shown for coupling to additional pressure cell structures, and connectors 715 and 716 are shown for coupling to pressure supply/exhaust components.

The support pad assembly also includes a pad 720 (e.g., foam) having a recess 722 in which the pressure cell structure 710 can be located. A cover 730 can be formed around the pad 720 with the pressure cell structure 710 therein. In some instances, the cover 730 has an opening on an underside 732 or end 734 for insertion or removal of the foam pad and pressure structure.

Figure 8:
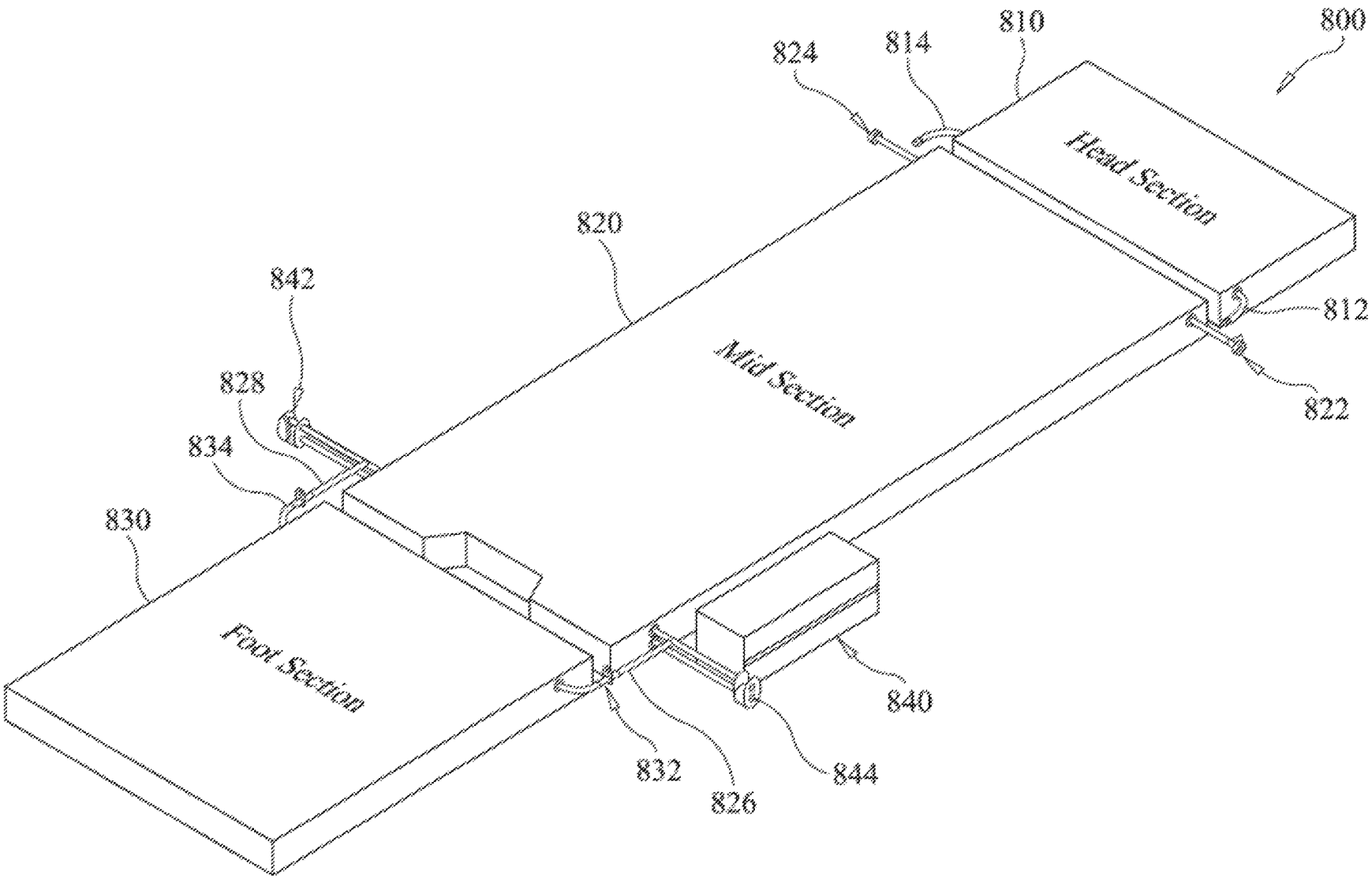
FIG. 8 shows a support pad, in accordance with the present disclosure.

FIG. 8 shows a support pad structure 800, in accordance with the present disclosure. Three sections are shown, by way of example labeled as head section 810, mid section 820 and foot section 830, which can be implemented for supporting the head, torso and feet of a patient. Each section includes a pressure cell structure, such as cell structure 710 shown in FIG. 7 and/or as may be implemented with pressure cells such as shown in FIG. 1 or in FIG. 10. A controller 840 is coupled for controlling inflation and deflation of pressure cells.

For illustration, the head section 810 is shown in a disconnected state, with connectors 812 and 814 respectively disconnected from connectors 822 and 824 of the mid section 820, and the foot section 830 is shown in a connected state with connectors 832 and 834 of the foot section respectively connected to connectors 826 and 828 of the mid section. Connectors 842 and 844 are configured for coupling to an external fluid supply/exhaust, and shown here with connector 844 coupled to controller 840.

Figure 9A:
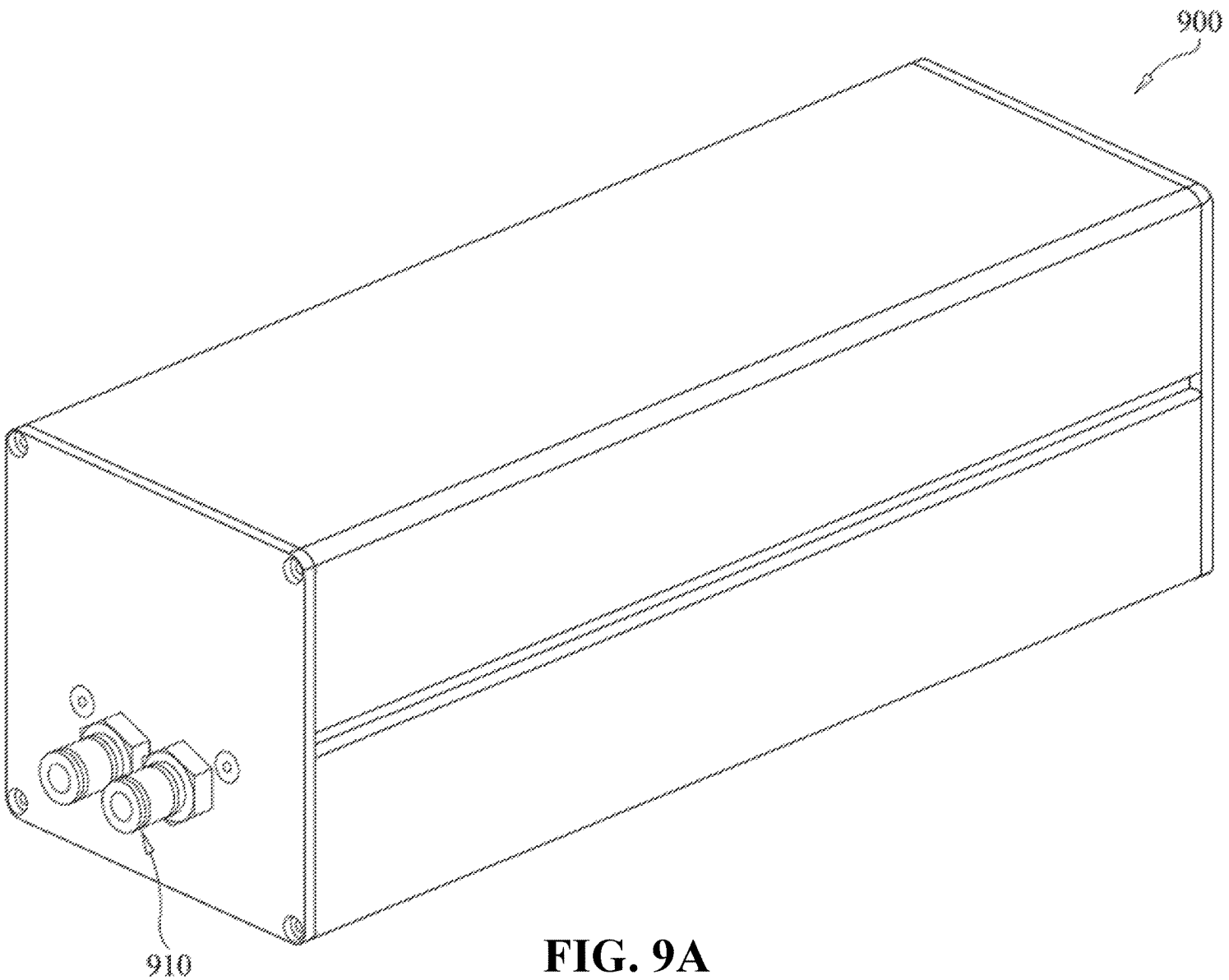
FIG. 9A shows an exterior of a pressure controller.
Figure 9B:
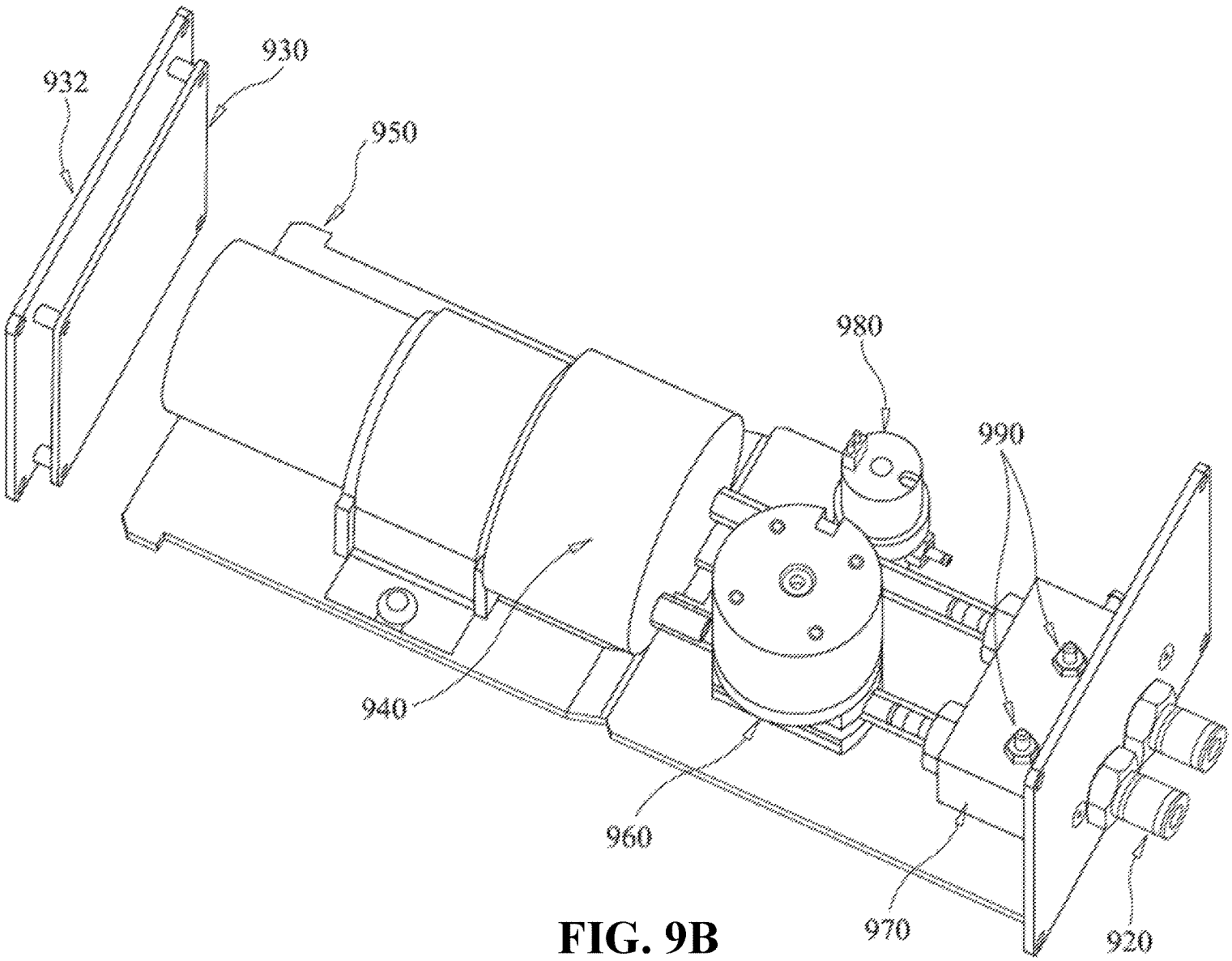
FIG. 9B shows an interior of the pressure controller, in accordance with the present disclosure.

FIG. 9A shows an exterior of a pressure controller 900, and FIG. 9B shows an interior of the pressure controller, in accordance with the present disclosure. Two fluid connectors 910 and 920 are shown respectively in FIGS. 9A and 9B, for coupling to a support structure such as that shown in FIG. 8 (e.g., with controller 900 implemented for controller 840). The fluid connectors may be used for supplying fluid to, and exhausting fluid from, respective pressure cells.

The pressure controller 900 includes a circuitry 930, with power and data connectivity at 932, which operate to control a pump 940 that is mounted on a mounting plate 950. A pinch valve 960 is optionally coupled between the pump 940 and a manifold 970, via which fluid flows to/from the fluid connectors 910 and 920. The pressure controller 900 may also include a relief valve 980 and pressure sensors 990, The pressure controller 900 can be implemented in a variety of manners. In some embodiments, the pump 940 is a bi-directional pump and is implemented with the pinch valve to hold pressure, with air being exhausted from one of two (or more) channels that fluid connectors 910 and 920 feed, and supplied to another one of the channels. For instance, if one of the channels is larger than the other, driving the smaller channel to a set high point pressure utilizing fluid from the large channel does not ensure that the larger channel drops to ambient pressure. The relief valve 980 can be used to let air into the system, such as to accommodate air loss over time and therein mitigate pressure drift. The pressure sensors 990 can be used to control the pump 940, to ensure that a respective channel being deflated has been drawn down to zero or some other set pressure value.

FIG. 10 shows another pressure cell structure 1000, in accordance with the present disclosure. As discussed above with FIGS. 3 and 4, spherical-type pressure cells may be implemented, with FIG. 10 showing one such embodiment. A plurality of pressure cells, with pressure cell 1020 shown by way of example, are integrated with an underlying surface 1010. Each cell exhibits an undercut region that facilitates shear relief, such as shown with FIG. 4. Alternating cells can be inflated/deflated on opposite cycles, facilitating pressure relief in manners as characterized herein.

Terms to exemplify orientation, such as upper/lower, left/right, top/bottom and above/below, may be used herein or shown in the drawings to refer to relative positions of components, such as those shown in the figures. It should be understood that the terminology is used for notational convenience only and that in actual use the disclosed structures may be oriented different from the orientation shown in the figures. Thus, the terms should not be construed in a limiting manner.

The skilled artisan would recognize that various terminology as used in the Specification (including claims) connote a plain meaning in the art unless otherwise indicated. As examples, the specification describes and/or illustrates aspects useful for implementing the claimed disclosure by way of various circuits or circuitry which may be illustrated as or using terms such as blocks, modules, device, system, unit, controller, clamp and/or other circuit-type depictions (e.g., controller circuit 531 of FIG. 5 or the componentry in FIGS. 9A and 9B may depict a block/module in this context). Such circuits or circuitry are used together with other elements to exemplify how certain embodiments may be carried out in the form or structures, steps, functions, operations, activities, etc. As another example, where the Specification may make reference to a "first [type of structure]", a "second [type of structure]", etc., where the [type of structure] might be replaced with terms such as ["circuit", "circuitry" and others], the adjectives "first" and "second" are not used to connote any description of the structure or to provide any substantive meaning; rather, such adjectives are merely used for English-language antecedence to differentiate one such similarly-named structure from another similarly-named structure (e.g., "first circuit configured to clamp . . . " is interpreted as "circuit configured to clamp . . . ").

Based upon the above discussion and illustrations, those skilled in the art will readily recognize that various modifications and changes may be made to the various embodiments without strictly following the exemplary embodiments and applications illustrated and described herein. For example, methods that may be implemented in forming the apparatuses characterized herein or as otherwise noted in the Figures may involve steps carried out in various orders, with one or more aspects of the embodiments herein retained, or may involve fewer or more steps. The respective elongated portions may be implemented with different arrangements to achieve a particular effect. As another example, different types of materials and configurations can be used to facilitate anti-shear effects. Such modifications do not depart from the true spirit and scope of various aspects of the disclosure, including aspects set forth in the claims.

What is claimed is:

1. An apparatus comprising:

a first set of elongated pressure cells;

a second set of elongated pressure cells interleaved with the pressure cells of the first set in a single layer;

a lower sheet layer having a planar upper surface that forms a lower interior sidewall surface of each of the first and second set of elongated pressure cells, each of the elongated pressure cells having an upper portion sealed to the planar upper surface of the lower sheet layer and having an interior surface area sealed to the planer upper surface and forming an enclosed pressure cell therewith;

a cover layer coupled to an upper sidewall of each pressure cell of the first and second sets of elongated pressure cells; and fluid delivery componentry configured and arranged with the first and second sets of pressure cells to support and provide shear relief to an object, alternately using the first and second sets of pressure cells, by:

supporting the object with the first set of pressure cells by inflating the first set of pressure cells, evacuating the second set of pressure cells and, via the evacuating, creating space between adjacent ones of pressure cells of the first set to facilitate shear deflection thereof into the created space while supporting the object, and supporting the object with the second set of pressure cells by inflating the second set of pressure cells, evacuating the first set of pressure cells and, via the evacuating, creating space between adjacent ones of pressure cells of the second set to facilitate shear deflection thereof into the created space while supporting the object.

2. The apparatus of claim 1, wherein each pressure cell includes respective undercut regions extending along a length of the pressure cell at intersections between the upper portion of the pressure cell and an underlying portion of the lower sheet layer to which the upper portion is sealed, the pressure cell at the intersection having a width that is less than a width of a cross-section of the pressure cell that is elevated above the intersection.

3. The apparatus of claim 2, wherein the width of the elevated cross-section is sufficiently larger than the width of the pressure cell at the intersection to facilitate deflection of an upper portion of the pressure cell in a direction along the width thereof, thereby providing the shear relief.

4. The apparatus of claim 3, wherein each of the pressure cells is configured and arranged with an upper surface that, when supporting the object, is configured and arranged to deflect 10 mm along a direction of the width relative to the intersections with the underlying surface.

5. The apparatus of claim 4, wherein each pressure cell is configured and arranged to exhibit the deflection when inflated and supporting the object.

6. The apparatus of claim 2, wherein the width of the pressure cell at the intersection is less than a width of a cross-section of the pressure cell that is elevated above the intersection when the pressure cell is filled with fluid that supports the object.

7. The apparatus of claim 1, wherein the fluid delivery componentry is configured and arranged to support and provide the shear relief to the object by:

inflating the first set of pressure cells while evacuating the second set of pressure cells by evacuating fluid from the second set of pressure cells and utilizing the evacuated fluid to inflate the first set of pressure cells; and inflating the second set of pressure cells while evacuating the first set of pressure cells by evacuating fluid from the first set of pressure cells and utilizing the evacuated fluid to inflate the second set of pressure cells.

8. The apparatus of claim 7, wherein the fluid delivery componentry includes valving and a pump configured and arranged to alternately inflate and deflate the first and second sets of pressure cells for respective periods of time.

9. The apparatus of claim 8, wherein the pump is a reversible pump and the valves are configured and arranged with the reversible pump and the sets of pressure cells to alternately inflate each of the first and second pressure cells utilizing the evacuated fluid from the other of the first and second pressure cells by reversing direction.

10. The apparatus of claim 1, wherein the fluid delivery componentry includes valving and a pump configured and arranged to independently inflate and deflate the first and second sets of pressure cells for respective periods of time.

11. The apparatus of claim 7, wherein evacuating the fluid from the second set of pressure cells includes removing all fluid that generates pressure from the second set of pressure cells;

evacuating the fluid from the first set of pressure cells includes removing all fluid that generates pressure from the first set of pressure cells; and each of the first and second sets of pressure cells is configured to support the object independently of the other of the first and second sets of pressure cells in response to the other of the first and second sets of pressure cells being evacuated.

12. The apparatus of claim 1, wherein the object is a human body and the pressure cells are configured and arranged to, with one of the sets of cells filled with fluid and on an underlying surface, prevent flattening of the pressure cells onto the underlying surface under a weight of the human body.

13. The apparatus of claim 1, wherein sets of pressure cells are in an upper sheet that is laminated to the lower sheet layer, the upper and lower sheet forming the respective cells when laminated.

14. The apparatus of claim 1, further including a pad having the first and second sets of pressure cells therein and an upper surface thereof, wherein the pad is configured and arranged with the first and second sets of pressure cells to mitigate the generation of shear forces on the upper surface via the deflection.

15. The apparatus of claim 1, wherein the first and second sets of pressure cells form a closed system in which fluid exhausted from one of the set of pressure cells is utilized to inflate the other one of the set of pressure cells, and further including a controller having circuitry and being configured and arranged to control alternating inflation and deflation of the first and second sets of pressure cells, the controller including a relief valve configured and arranged to facilitate intake of fluid into the apparatus for inflating the respective sets of pressure cells, in response to detecting loss of fluid from the closed system.

16. An apparatus comprising:

a first set of elongated pressure cells;

a second set of elongated pressure cells, each pressure cell in the second set being interleaved with the pressure cells of the first set in a single layer;

a lower sheet layer having a planar upper surface that forms a lower interior sidewall surface of each of the first and second set of elongated pressure cells, each of the elongated pressure cells having an upper portion sealed to the planar upper surface of the lower sheet layer and having an interior surface area sealed to the planer upper surface and forming an enclosed pressure cell therewith;

a cover layer coupled to an upper sidewall each pressure cell of the first and second sets of elongated pressure cells; and fluid delivery componentry configured and arranged with the first and second sets of pressure cells to provide shear relief, alternately using the first and second sets of pressure cells, by:

inflating the first set of pressure cells, evacuating the second set of pressure cells and, via the evacuating, creating space between adjacent ones of pressure cells of the first set to facilitate shear deflection thereof, and inflating the second set of pressure cells, evacuating the first set of pressure cells and, via the evacuating, creating space between adjacent ones of pressure cells of the second set to facilitate shear deflection thereof.

17. A method comprising:

providing first and second sets of elongated pressure cells in a single layer and connected to a lower sheet layer and an upper cover layer, each pressure cell in the second set being interleaved with the pressure cells of the first set, the lower sheet layer having a planar upper surface that forms a lower interior sidewall surface of each of the elongated pressure cells, each of the elongated pressure cells having an upper portion sealed to the planar upper surface of the lower sheet layer and forming an enclosed pressure cell therewith, the upper cover layer being coupled to an upper sidewall of each pressure cell of the first and second sets of elongated pressure cells;

in a first step, inflating a first set of elongated pressure cells while evacuating a second set of elongated pressure cells, and creating space, via the evacuating, between adjacent ones of pressure cells of the first set to facilitate shear deflection thereof, each pressure cell in the first set being interleaved with the pressure cells of the second set; and in a second step, inflating the second set of pressure cells while evacuating the first set of pressure cells, and creating space, via the evacuating, between adjacent ones of pressure cells of the second set to facilitate shear deflection thereof.

18. The method of claim 17, wherein the first and second steps are carried out alternately and repeated, therein alternately inflating and deflating the first and sets of pressure cells.

19. The method of claim 18, further including using, in each step, inflated ones of the pressure cells to support an object while allowing deflection of the inflated ones of the pressure cells into the space created via by deflated ones of the pressure cells.

20. The method of claim 18, wherein:

inflating the first set of elongated pressure cells while evacuating the second set of elongated pressure cells includes evacuating fluid from the second set of pressure cells and using the evacuated fluid to inflate the first set of pressure cells; and inflating the second set of elongated pressure cells while evacuating the first set of elongated pressure cells includes evacuating fluid from the first set of pressure cells and using the evacuated fluid to inflate the second set of pressure cells.

* * * * *